US007104019B2

(12) United States Patent
Brunnhofer

(10) Patent No.: US 7,104,019 B2
(45) Date of Patent: Sep. 12, 2006

(54) COMPOSITE INSULATING PROFILE

(75) Inventor: Erwin Brunnhofer, Fuldabrück (DE)

(73) Assignee: Technoform Caprano und Brunnhofer GmbH & Co. KG, Kassel (DE)

( * ) Notice: Subject to any disclaimer, the term of this patent is extended or adjusted under 35 U.S.C. 154(b) by 0 days.

(21) Appl. No.: 10/986,564

(22) Filed: Nov. 10, 2004

(65) Prior Publication Data

US 2005/0115193 A1 Jun. 2, 2005

(30) Foreign Application Priority Data

Nov. 11, 2003 (EP) ..... 03025858

(51) Int. Cl.
*E04B 1/74* (2006.01)

(52) U.S. Cl. ..... 52/407.1; 52/309.9

(58) Field of Classification Search ..... 52/204.1, 52/309.9, 794.1, 784.15, 232, 407.1
See application file for complete search history.

(56) References Cited

U.S. PATENT DOCUMENTS 5,694,731 A * 12/1997 Tonsmann et al. ..... 52/656.3

FOREIGN PATENT DOCUMENTS

| | | | |
|---|---|---|---|
| DE | 4131511 | A1 * | 4/1993 |
| DE | 4321702 | A1 * | 1/1995 |
| DE | 94 13 790 | | 2/1996 |
| DE | 196 22 278 | | 10/1997 |
| DE | 94 22 032 | | 12/1997 |
| DE | 100 39 980 | | 2/2002 |
| EP | 58554 | A1 * | 8/1982 |
| EP | 560193 | A1 * | 9/1993 |
| EP | 0 636 760 | | 2/1995 |
| EP | 0 978 619 | | 2/2000 |
| EP | 1 318 262 | | 6/2003 |
| FR | 2604739 | A1 * | 4/1988 |

* cited by examiner

*Primary Examiner*—Naoko Slack
(74) *Attorney, Agent, or Firm*—Andrew Wilford

(57) ABSTRACT

A composite profiled construction element has a pair of metallic, elongated, and transversely spaced profiles having inner faces spaced from and directed toward each other and a pair of elongated and transversely spaced connector webs bridging the profiles, having outer edges fixed in the profiles and inner faces spaced from and directed toward each other. The inner faces of the profiles and of the webs define a longitudinally extending passage. An elongated insulating body in the passage has a first outer face fixed to one of the inner faces and is formed with a longitudinal ridge operatively bearing on another of the inner faces. The body also has a second outer face spaced from and forming an empty longitudinally extending space with another of the inner faces.

12 Claims, 3 Drawing Sheets

PRIOR ART

COMPOSITE INSULATING PROFILE

FIELD OF THE INVENTION

The present invention relates to a composite insulating profile or construction element. More particularly this invention concerns such a profiled element used as a door or window frame or to secure a facade element.

BACKGROUND OF THE INVENTION

A standard profiled construction element comprises inner and outer metallic, normally aluminum, profiles that extend parallel to each other and that are bridged by a pair of webs, often formed of plastic. The outer metal profile is exposed to the elements on the outside of the building and the inside profile is turned to the interior, with the two plastic webs forming a thermal bridge between them. Inner faces of the profiles and of the webs define a longitudinally extending and transversely closed passage.

In order to increase the insulating capacity of such a structure, to make it mechanically more rigid, and to prevent convection currents inside it, it is known from German patent documents 94 22 032 and 100 39 980 and from EP 0,978,619 and EP 1,318,262 to substantially completely fill this space with an insulating body, normally a closed-cell rigid plastic foam. It is also known from German 94 13 790 and EP 0,636,760 to provide such a foam body having oppositely directed broad outer faces bonded in surface contact to inner faces of opposing inner walls of the element.

Such structures have the disadvantage that when they are exposed to substantial heat, the plastic body can expand and deform the plastic webs. This can particularly occur at the high temperatures of certain lacquering operations. Furthermore manufacture of them is fairly difficult as the plastic insulating body must normally be formed in situ in the finished four-part structure.

Another system described in German 196 22 278 has a pair of bars of insulating material fixed to inner faces of the two bridging webs. These bars do not contact anything other than the web they are fixed to. They serve mainly to interfere with convective flow in the structure. Overall they offer poor insulating performance and do not prevent deformation of the structure.

OBJECTS OF THE INVENTION

It is therefore an object of the present invention to provide an improved composite profiled construction element.

Another object is the provision of such an improved composite profiled construction element that overcomes the above-given disadvantages, in particular that is easy to manufacture, that is resistant to deformation, and that is not liable to deform if heated.

SUMMARY OF THE INVENTION

A composite profiled construction element has according to the invention a pair of metallic, elongated, and transversely spaced profiles having inner faces spaced from and directed toward each other and a pair of elongated and transversely spaced connector webs bridging the profiles, having outer edges fixed in the profiles and inner faces spaced from and directed toward each other. The inner faces of the profiles and of the webs define a longitudinally extending passage. An elongated insulating body in the passage has a first outer face fixed to one of the inner faces and is formed with a longitudinal but narrow ridge operatively bearing on another of the inner faces. The body also has a second outer face spaced from and forming an empty longitudinally extending space with another of the inner faces.

Thus the space inside the element is not completely filled. It is filled at least 50%, and normally about 75%. Thus at most 50% and preferably only about 25% of the space inside the element is empty, that is filled only with air. There is therefore substantial room for the insulating body to expand without deforming and damaging the profiles or webs. As a result a high-temperature lacquering operation will not deform the element, at worst it will cause the foam body to fill somewhat more of the passage.

The invention is based on the surprising discovery that, even if the interior of the profiled construction element is not completely filled with insulation, it is possible to achieve comparably thermal performance and mechanical strength. The empty space in the passage makes it possible to submit the construction element to various processes, such as hot lacquering, without worrying about it deforming and becoming useless. Even if the insulating body is overheated so that it expands somewhat, it will merely fill more of the passage, and its ridge will not deform one of the webs or profiles.

The webs according to the invention are thicker at the edges than therebetween and the profiles are each formed with a pair of grooves flanking the respective inner face and of a cross section complementary to that of the edge it holds, normally dove-tail shaped. Each of the edges is complementarily received in a respective one of the grooves. The insulating body is fitted snugly between the edges of the one web. The use of such a narrow ridge to transmit mechanical force ensures that, even if the body overall expands somewhat, the narrow ridge will not be strong enough to deform the web or profile it engages.

The insulating body is of foam plastic. In addition according to the invention the one inner face to which the first outer face of the insulating body is fixed and the first outer face are formed with interfitting and longitudinally extending formations, e.g. ridges on the inner faces and complementary grooves on the insulating bodies.

The first outer face of the insulating body is fixed to the inner face of one of the webs and extends over at least 60% and preferably about 70% of the width of this inner face, that is across the distance measured from the inside to the outside profile. The body can be glued, welded, or clamped to the inner face it is fixed to.

The composite profiled construction element further has according to the invention a second insulating body in the passage that is essentially identical to but separate from the first-mentioned body. The second body has a first outer face fixed to the inner face of the other of the webs, is formed with a longitudinal ridge operatively bearing on another of the inner faces, and has a second outer face spaced from and forming an empty longitudinally extending space with another of the inner faces. The ridge of each body bears via the other body on the respective inner face. Furthermore, each of the bodies is formed with a longitudinally extending groove having a pair of flanks snugly engaging the ridge of the other body.

The spaces according to the invention are formed between the inner faces of the profiles and the bodies. The bodies have third outer faces confronting and spaced transversely from each other. The ridges and grooves are formed in the third outer faces. These grooves have longitudinally extending floors spaced transversely from and defining an empty space with the ridges they receive.

In another element according to the invention the ridge engages directly against the inner face of one of the profiles.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
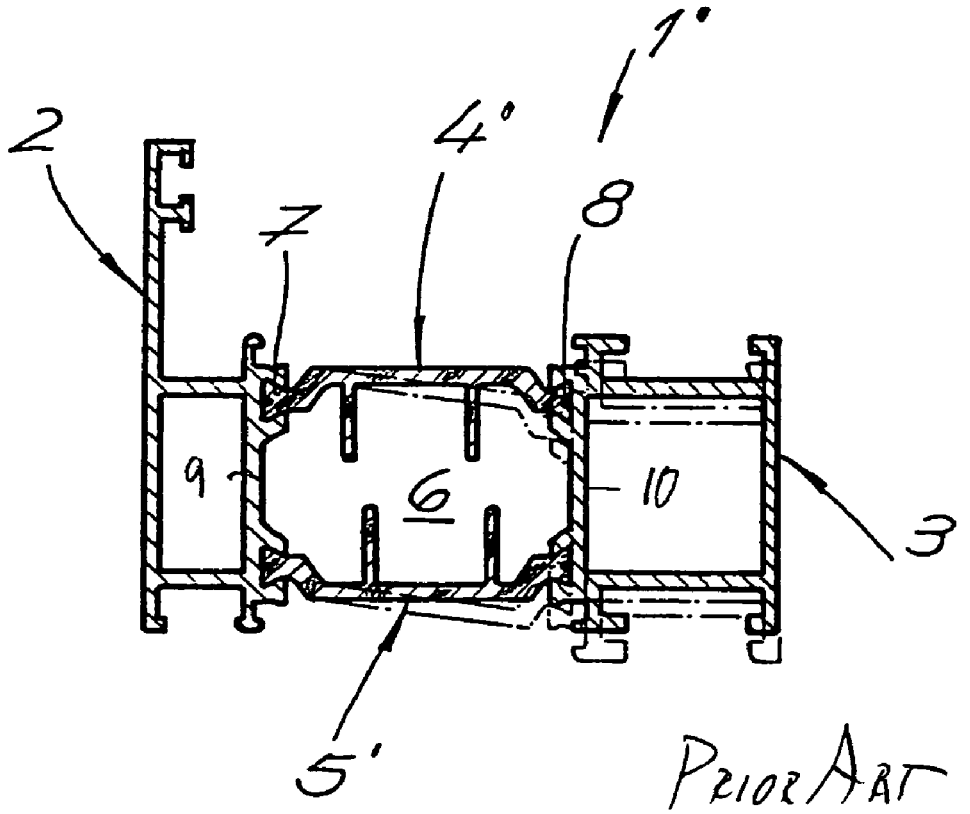
FIG. 1 is a small-scale cross section through a prior-art composite profile.

As seen in FIG. 1 a prior-art composite profiled building element 1' is comprised of an outside profile 2 of aluminum and an inside profile 3 also of aluminum. A pair of identical and parallel rigid plastic webs 4' and 5' have thickened outer edges 7 received in complementary dove-tail section grooves 8 of the profiles 2 and 3. Thus the webs 4' and 5' together with walls 9 and 10 of the profiles 2 and 3 form a longitudinally extending empty space 6. The dot-dash lines in FIG. 1 show the position assumed by the webs 4' and 5' and the profile 3 during the type of deformation frequently taking place during painting or handling. Such deformation makes it difficult to use the profile 1', as it will not fit as desired, making, for instance, seals ineffective in a door or window assembly.

Figure 2:
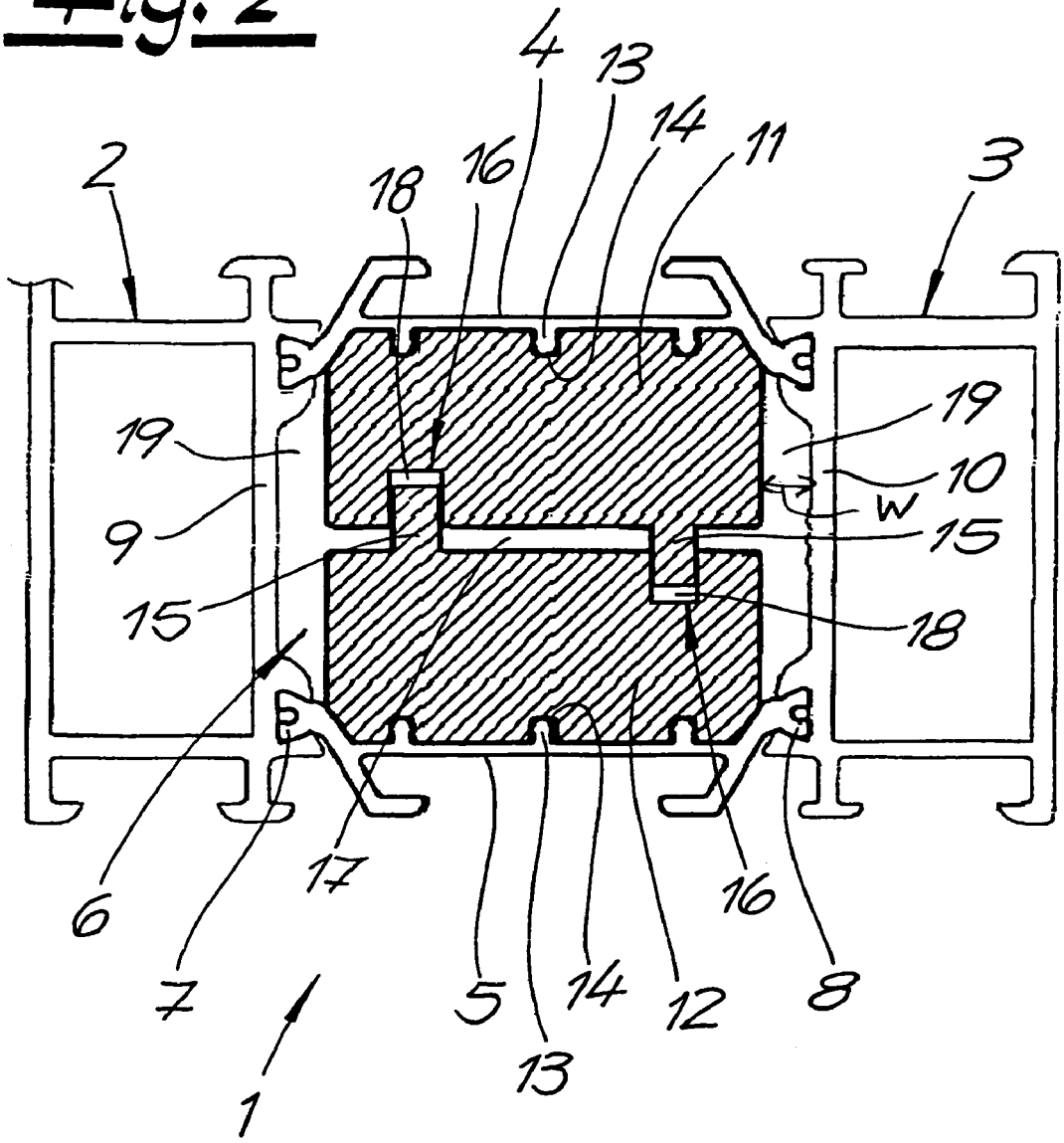
FIGS. 2 and 3 are cross sections through composite profiles according to the invention.
Figure 3:
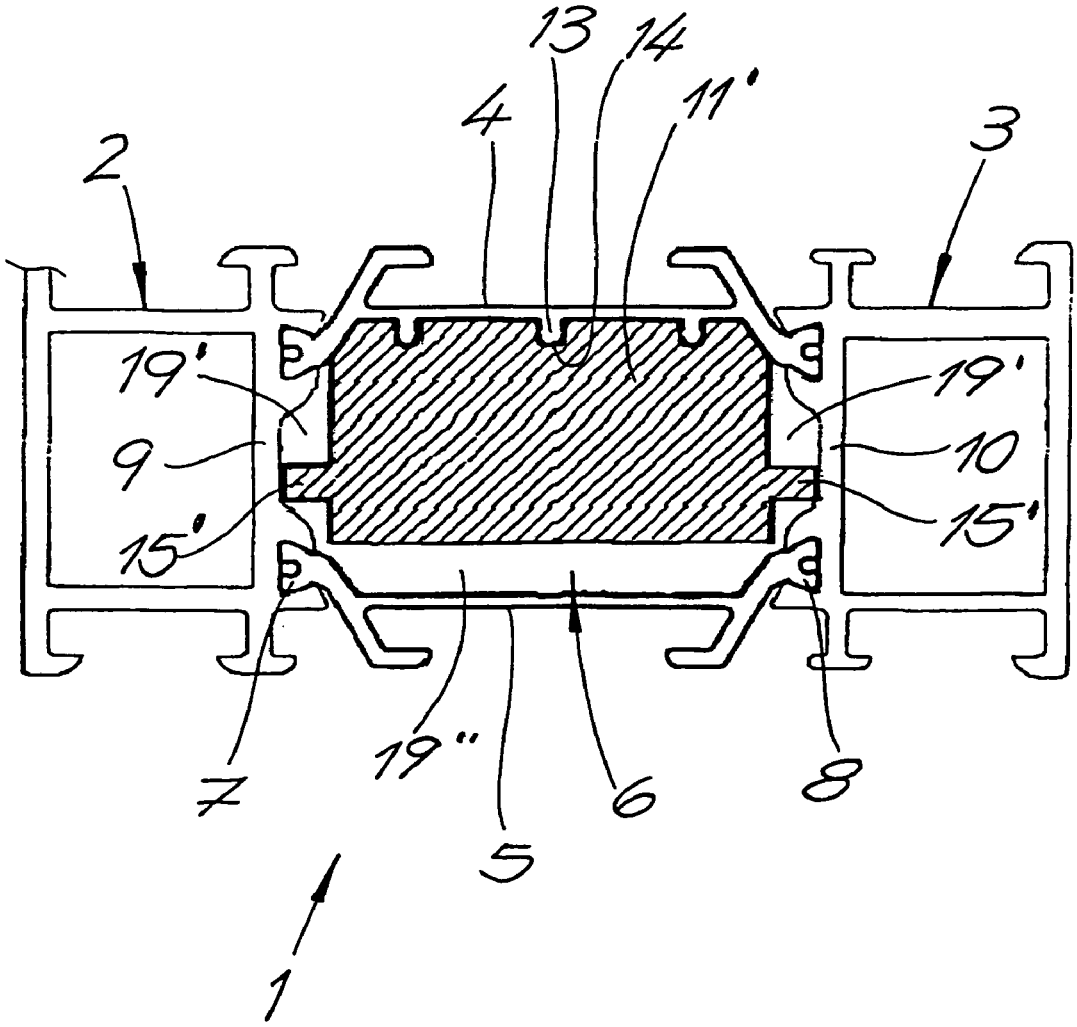

FIGS. 2 and 3 show the system of the instant invention, using reference numerals from FIG. 1 for functionally identical structure.

In FIG. 2 two profiles 2 and 3 are bridged by plastic webs 4 and 5 to each of which is fixed a respective insulating body 11 and 12, here of closed-cell polyurethane or polystyrene foam. To this end inner faces of the webs 4 and 5 are formed with inwardly projecting ridges 13 received and tightly engaged in complementary longitudinal dove-tail grooves 14 of the bodies 11 and 12. In addition each of the bodies 11 and 12 is formed on its outer face turned away from the respective web 4 and 5 with a rectangular-section and longitudinally extending narrow ridge 15 fitting snugly between the side flanks of a respective complementary groove 16 of the other body 11 and 12. The outer faces of the bodies 11 and 12 are separated by a longitudinally extending space 17, and the ridges 15 define further longitudinally extending empty spaces 18 in the grooves 16. Furthermore the side outer faces of each of the bodies 11 and 12 form empty side spaces 19 with the inner faces of the respective walls 9 and 10 of the profiles 2 and 3. The spaces 17 and 19 have a width W of between 1.5 mm and 5 mm, preferably 2 mm to 4 mm, and ideally 2.5 mm to 3.5 mm. These spaces 17, 18, and 19 allow the bodies 11 and 12 to expand transversely without deforming the profiles 2 and 3 or the webs 4 and 5.

In the arrangement of FIG. 3 there is only a single body 11' in the space 6, fixed to the web 4 and having a pair of oppositely projecting ridges 15' bearing on the inner faces of the walls 9 of the side profiles 2 and 3. There is still a space 19' between each outer side face of the body 11' and the walls 9 and 10 and another such space 19" formed with the web 5.

I claim:

1. A composite profiled construction element comprising:

a pair of metallic, elongated, and transversely spaced profiles having inner faces spaced from and directed toward each other;

a pair of elongated and transversely spaced connector webs bridging the profiles, having outer edges fixed in the profiles and inner faces spaced from and directed toward each other, the inner faces of the profiles and of the webs defining a longitudinally extending passage; and an elongated insulating body in the passage, having a first outer face fixed to one of the inner faces and a second outer face turned toward and spaced from another of the inner faces, formed with a longitudinal ridge projecting from the second face and operatively bearing on the other of the inner faces, and having a third outer face spaced from and forming an empty longitudinally extending space with another of the inner faces.

2. The composite profiled construction element defined in claim 1 wherein the webs are thicker at the edges than therebetween and the profiles are each formed with a pair of grooves flanking the respective inner face, each of the edges being complementarily received in a respective one of the grooves, the insulating body being fitted snugly between the edges of the one web.

3. The composite profiled construction element defined in claim 1 wherein the insulating body is of foam plastic.

4. The composite profiled construction element defined in claim 1 wherein the one inner face to which the first outer face of the insulating body is fixed and the first outer face are formed with interfitting and longitudinally extending formations.

5. The composite profiled construction element defined in claim 1 wherein the first outer face of the insulating body is fixed to the inner face of one of the webs.

6. The composite profiled construction element defined in claim 5, further comprising:

a second insulating body in the passage, separate from the first-mentioned insulating body, having a first outer face fixed to the inner face of the other of the webs and a second outer face turned toward another of the inner faces, formed with a longitudinal ridge projecting from the respective second face and operatively bearing on the other of the inner faces, and having a third outer face spaced from and forming an empty longitudinally extending space with another of the inner faces.

7. The composite profiled construction element defined in claim 6 wherein the ridge of each body bears via the other body on the respective inner face.

8. The composite profiled construction element defined in claim 6 wherein each of the bodies is formed with a longitudinally extending groove having a pair of flanks snugly engaging the ridge of the other body.

9. The composite profiled construction element defined in claim 8 wherein the spaces are formed between the inner faces of the profiles and the bodies.

10. The composite profiled construction element defined in claim 8 wherein the bodies have fourth outer faces confronting and spaced transversely from each other, the ridges and grooves being formed in the fourth outer faces.

11. The composite profiled construction element defined in claim 8 wherein the grooves have longitudinally extending floors spaced transversely from and defining an empty space with the ridges they receive.

12. The composite profiled construction element defined in claim 1 wherein the ridge engages directly against the inner face of one of the profiles.

* * * * *